United States Patent [19]

Clotten et al.

[11] Patent Number: 4,955,139

[45] Date of Patent: Sep. 11, 1990

[54] CUTTING TOOLS HAVING A PLASTIC HANDLE

[75] Inventors: Wilfried Clotten, Langenfeld; Rainer Feige, Wermelskirchen, both of Fed. Rep. of Germany

[73] Assignee: J. A. Henckels Zwillingswerk Aktiengesellschaft, Solingen, Fed. Rep. of Germany

[21] Appl. No.: 185,531

[22] Filed: Apr. 25, 1988

[30] Foreign Application Priority Data

Apr. 25, 1987 [DE] Fed. Rep. of Germany ..... 3713958

[51] Int. Cl.[5] ..... B25G 1/00

[52] U.S. Cl. ..... 30/340; 30/329

[58] Field of Search ..... 30/340, 329, 337, 308.1–322, 30/324

[56] References Cited

U.S. PATENT DOCUMENTS 4,719,063 1/1988 White ..... 30/340

FOREIGN PATENT DOCUMENTS 839272 12/1938 France ..... 30/340

*Primary Examiner*—Frank T. Yost
*Assistant Examiner*—Willmon Fridie, Jr.
*Attorney, Agent, or Firm*—Martin A. Farber

[57] ABSTRACT

A cutting tool, particularly a knife, is formed of a blade and handle, the blade having a tang which extends into the handle. The handle is configured with an insertion shaft having sidewalls and a height greater than its width as measured in cross section. The insertion shaft receives the tang. Portions of the sidewalls are cut out to form elongated recesses giving the shaft the shape of a cross as viewed in cross section. Lugs are formed at ends of the recesses facing the blade for secure engagement with the tang.

6 Claims, 3 Drawing Sheets

CUTTING TOOLS HAVING A PLASTIC HANDLE

FIELD AND BACKGROUND OF THE INVENTION

The present invention relates to a cutting tool provided with a plastic handle, particularly knives, the handle having an insertion shaft into which an attachment section of the cutting tool is held by a snug fit between cutting tool and handle.

The attachment section of the cutting tool has a cross-section which, as a rule, is only a fraction of the cross-section of the handle. Particularly in the case of flat attachment sections, substantial different accumulations of material frequently result for the supplementing of the three-dimensional shape of the handle. Larger accumulations of material drop inwards a substantial amount due to shrinkage of the material upon cooling. The indentations produced thereby, to be sure, constitute merely a cosmetic deficiency, but they are not looked upon with favor in view of the otherwise precision appearance of the cutting tool, particularly by quality-conscious customers.

Summary of the invention

The object of the present invention is to create by simple means a handle-attachment with which a visually pleasing effect is obtained without, however, impairing the stability.

As a result of the invention, a plastic-handle attachment is obtained which is beyond reproach both in appearance and in stability. The means are simple and suitable. The insertion shaft, viewed in cross-section, is provided, spaced from its two ends, with a widening of its cross-section on each wide side of the shaft. This prevents the aforementioned falling inward of the wall of the handle which otherwise would occur as a result of the increased accumulation of material. The cross-shaped channel furthermore permits the introduction of cooling channels which, among other things, shortens cycle times upon an injection molding. After the removal of the handle from the mold it rather has a completely homogeneous, i.e. smooth surface. In addition to this, there is also the advantage of a saving of material, which today is definitely once again of interest. The cooling also takes place faster. Despite the fact that the full shape of the shaft no longer grips the attachment section as a result of the cross-sectional widenings, the required stability in use is nevertheless retained as a result of the distance of these widenings from the ends of the attachment section of the cutting tool which are otherwise gripped in this cross-sectional plane by the shaft. The insertion shaft together with the widenings in cross-section forms, seen in cross-section, a cross-shaped channel, which also facilitates the removing of the handle from the mold. A further advantageous development resides in the fact that the handle is provided on its end surface, in the region of the root of each widening of the cross-section, with free standing lugs which are molded directly thereon. They converge in the freestanding direction towards each other, produced by a deforming before mounting. In this way, additional material is provided so as, by partial melting away of the end surface of the handle to obtain a connection which is sufficiently tight against the penetration of water. Since furthermore the inside distance between the ends of the lugs is at least as great as the width of the insertion shaft, the section which has not been melted off travels like a closure cap into the widening of the cross-section. They therefore contribute, in addition, also to the form-locked gripping of the edge of the attachment section corresponding to the thickness of the lugs.

Furthermore, the fact that the attachment shaft has undercuts for the anchoring of handle material which has been melted is favorable from the standpoint of the attachment. The attachment section can be the tang of a knife. The type of attachment described proves excellent, specifically for the obtaining of wash-resistant and particularly washing-machine-resistant cutlery. Finally, one advantageous feature of the invention is that the lugs are provided on their end surfaces on the shaft side with ledge projections which extend over the entire width of the lugs. The projections, as a result of their reduction in cross-section as compared with the body of the lugs, form zones which are particularly easily melted and further assist in special fashion in obtaining the desired tight closure.

DETAILED DESCRIPTION OF THE PREFERRED EMBODIMENT

Figure 1:
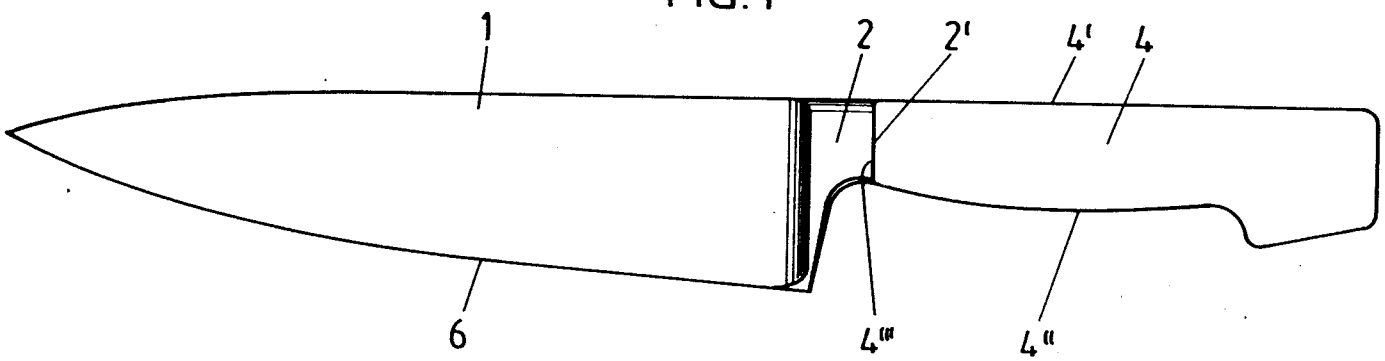
FIG. 1 is a side view of a knife.

The knife blade shown, in this case a kitchen knife, consists of the blade 1, the collar 2 and the tang 3.

The tang 3 is the, generally narrowed, section of the blade which, via the collar 2, adjoins the knife blade and is connected by the action of heat to a handle 4.

The handle 4, which is made of suitable thermoplastic resin, has an insertion shaft 5 which extends into an end region remote from the blade.

The insertion shaft 5 extends practically over the width of the handle as seen in the plane of the blade, it being closer to the back 4' of the handle than to the opposite side 4'' of the handle (which side is closer to the cutting edge 6 of the blade 1).

The tang, which forms the attachment section of the blade, is formed of flat material, preferably stamped, which is welded to the collar 2. The weld bead which extends in collarlike manner around it is designated 7.

The cross-section of the tang is smaller on all sides than the edge of the collar. In the present example, the collar 2 is developed as a high collar, in part, with a collar edge length which corresponds to several times that of a table knife. This substantially increased length of the collar edge is present here substantially only in the section to which the tang 3 is attached. The section of the collar 2 which faces in the direction of the cutting edge 6 of the knife is, on the other hand, narrow. It tapers down as customary towards the cutting-edge side.

The main portion of the surface of the tang-side attachment surface 2' of the collar 2 lies free. This attachment surface 2' is flat, i.e. it extends perpendicular to the longitudinal axis x—x of the tang 3.

Figure 3:
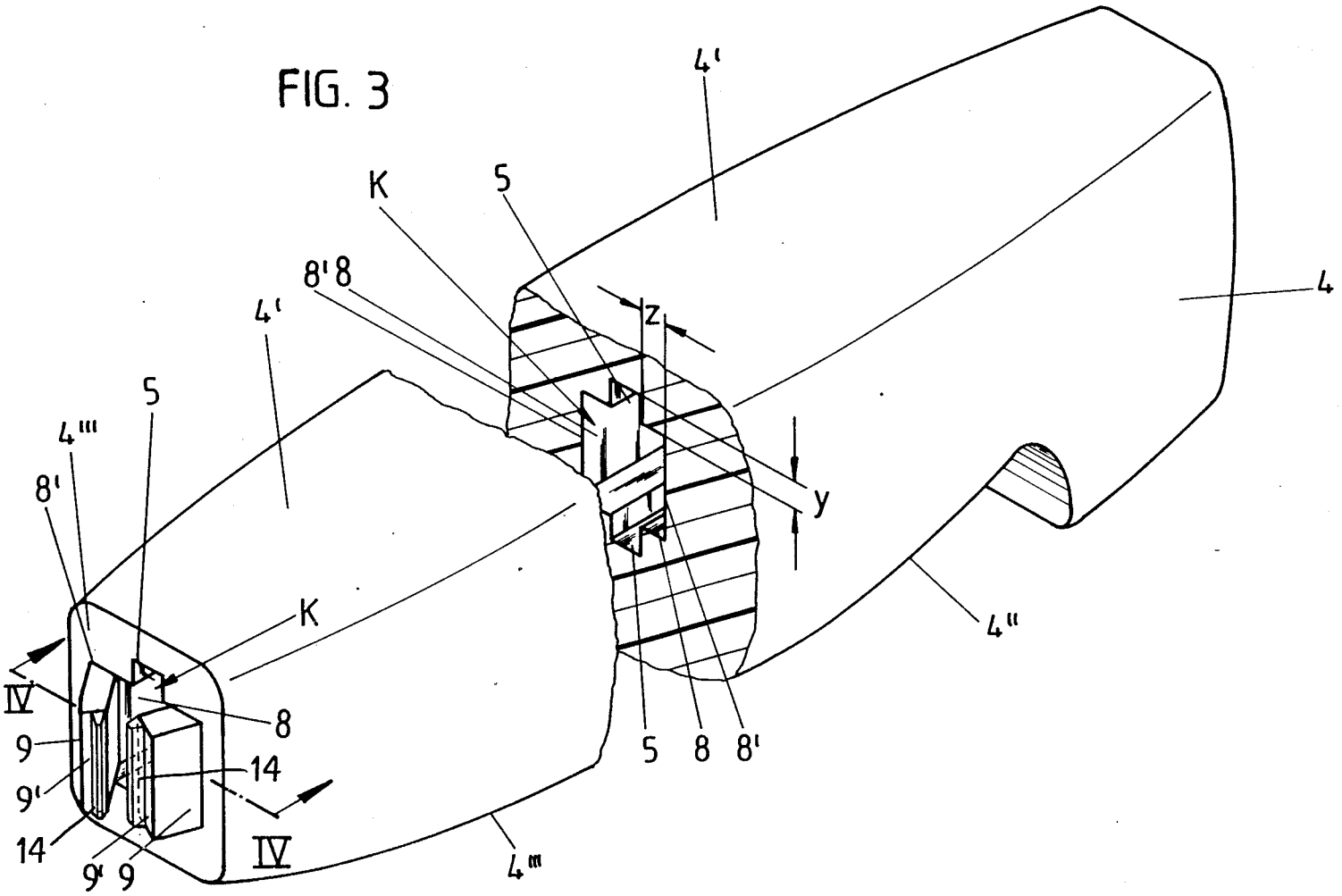
FIG. 3 shows the handle in perspective, in an enlarged view, broken apart.
Figure 5:
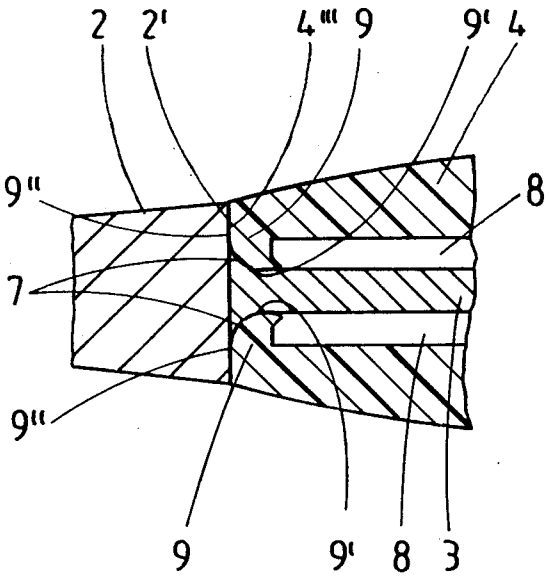
FIG. 5 is a corresponding view after thermal attachment has been effected.

The insertion shaft 5 of the handle 4 is spaced, as seen in cross-section, from its two ends (seen in the plane of the knife blade); on each wide side of the shaft, it has a widening 8 of the cross-section (see FIG. 3). The spacing distance y has a length which assures a sufficiently firm grip around the end edge of the tang 3. The corresponding form-locked gripping is therefore done away with only in the central region, i.e. on the wide sides of the shaft. Insertion shaft 5 and the two cross-sectional widenings 8 result in a cross-shaped channel K. The depth z of the cross-sectional widening 8 measured in the transverse direction corresponds approximately to the measurement y and the latter corresponds to the thickness of the material of the tang 3. The width of the cross-sectional widening is a multiple of y. The hollowing of the handle which goes beyond the actual form-locked grip not only leads to a saving in material but also avoids the danger of the outer surface of the handle falling inward upon the removal of the handle from the plastic injection mold.

Figure 4:
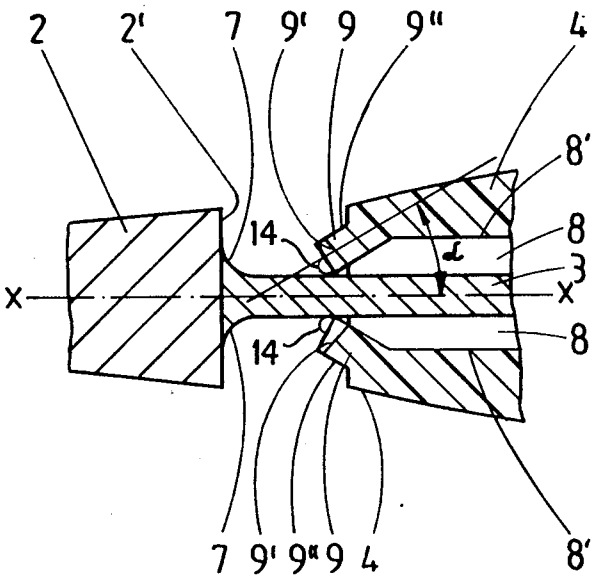
FIG. 4 is a section along the line IV of FIG. 3, with the tang inserted into the insertion shaft, seen in an intermediate assembly position.

In order nevertheless to obtain as congruent as possible an end surface 4''' for the sleeve shaped plastic handle 4 with respect to the attachment surface 2', said handle bears on its end surface 4''' in the region of the bottom 8' of the cross-sectional widenings 8, in each case a freestanding lug 9 which is simultaneously molded thereon (reference is had to FIGS. 3 and 4).

The two lugs 9, which are the same length, converge in the direction towards their free stand. The angle of inclination alpha is about 40° referred to the longitudinal central axis x—x (FIG. 4).

The thickness of the lugs 9 corresponds approximately to the depth z of a widening of the cross-section. The inside distance between the ends of the lugs 9, or, stated more precisely, between their adjacent corner edges, is at least as great as the width of the insertion shaft 5, i.e. corresponding to the thickness of the tang. The lugs 9 are rooted both in the end surface 4''' of the handle and on the bottom 8' of the widening. This can be clearly noted from FIG. 4.

The lugs 9 have the end surfaces 9'.

The attachment of the handle 4 is effected as follows: The region of the collar 2 is heated (induction heating). The possibly preheated corresponding end region of the handle 4, after being placed over the free end of tang 3, is pushed into proper position in the direction towards the collar 2, the rectangular tang cross-section entering tightly into the insertion shaft 5 with its narrow longitudinal edges being gripped. As a result of the free distance between the lugs 9, they retain their converging initial direction until the end. Their outward-directed corner edges then come against the heated attachment surface 2' of the collar 2. The handle material present there softens.

In this way, the lugs 9, which are also plasticized, are guided inward. They travel, filling out the cross-sectional, into the cross-section widening 8 which is adapted to the cross-section. The outer flanks 9'' extend finally in the same plane as the end surface 4''' of the handle 4. In this way a continuous melting of this end surface 4''', which is closed in corresponding shape around the cross-section of the tang, onto the corresponding attachment surface 2' of the collar 2 is obtained. The weld bead 7 forms a bed for itself in the corresponding mouth edge of the insertion shaft. In this way, a high quality sealing is also obtained, not least of all by the strips 10, as well as a permanent attachment.

Wash water or the like is not able to enter into cross-shaped channel K. The life of the knife is thereby considerably increased. Furthermore, only a relatively small accumulation of material is present in the region of the lugs, so that accordingly there is also no falling inward of the handle wall as a result of heating, such as generally found disturbing for esthetic reasons.

Figure 2:
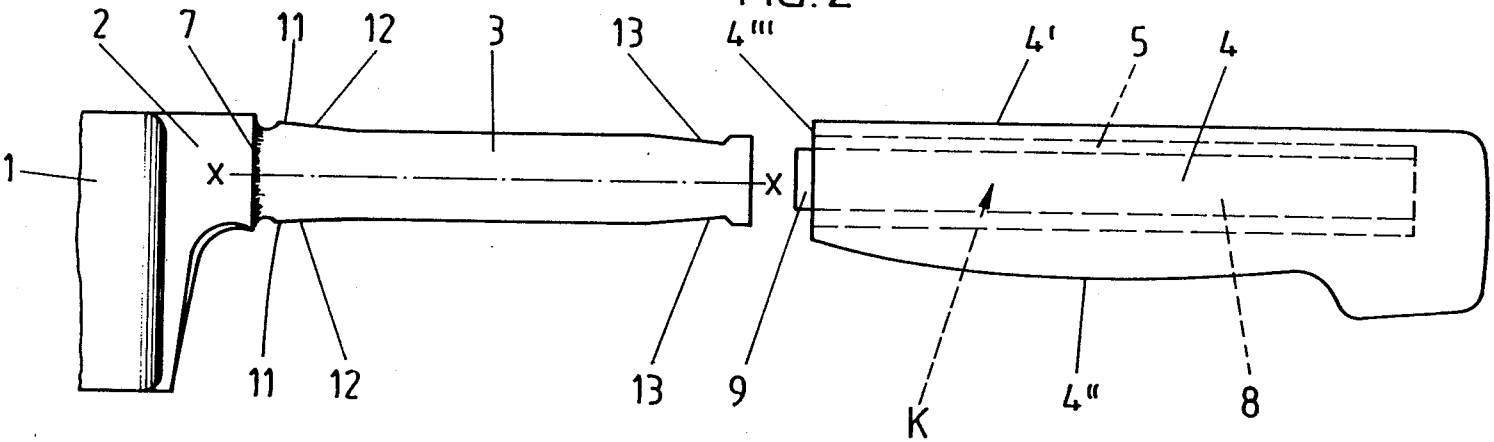
FIG. 2 shows the tang/collar region, also in side view, with the handle not yet attached.

Another measure of the attachment of the handle consists therein that the attachment section of the blade, i.e. the tang 3, has projections 11 for the anchoring of molten handle material on the narrow sides of the flat tang body (see FIG. 2).

Following this, the edge continues in a run-on bevel 12 which slightly widens the handle material and permits the pushed-over part to contract inward as a result of the undercuts 11. On both narrow sides of the tang there is then also a niche 13 in the free end region thereof.

All new features mentioned in the specification and shown in the drawing are essential to the invention even if they are not expressly indicated in the claims.

I claim:

1. A cutting tool, particularly a knife, comprising
a handle;
blade means, the blade means including an attachment section rearward of the blade means; and wherein
the handle includes an insertion shaft for receiving the attachment section with a snug connection between said blade means and said handle, the insertion shaft being configured with a cross-section of wide and narrow sides, and having cross-sectional widenings, extending longitudinally on opposite wide sides of the shaft, inner surfaces of said widenings being spaced from said attachment section;
the handle comprises, on an end surface facing the blade means, freestanding lugs located in registration with corresponding cross-sectional widenings, the lugs converging towards each other in a generally forward direction of the attachment section and being inclined relative to a longitudinal axis of the handle; and wherein
an inside distance between ends of the lugs is at least as great as a width of the attachment section, the length of each lug being greater than a spacing between the attachment section and an inner surface of the insertion shaft; and
a forward end of said attachment section extends in width beyond said inside distance for engagement with said lugs to increase convergence of said lugs into locking engagement with said attachment section upon insertion of said attachment section into said shaft, said locking engagement bending said lugs in a direction perpendicular to said attachment section and introducing a longitudinal compression to each lug for a tight grip between said attachment section and said handle.

2. A cutting tool according to claim 1, wherein
the insertion shaft together with the cross-sectional widenings form a cross-shaped channel.

3. A cutting tool according to claim 1, wherein
the attachment section has projections for anchoring the handle.

4. A cutting tool according to claim 1, wherein
the attachment section has the form of the tong of a knife.

5. A cutting tool according to claim 1, wherein
the lugs are provided on their end surfaces on the shaft side with ledge projections extending over the entire width of the lugs.

6. A cutting tool according to claim 1, wherein
the lugs are provided with projections directed toward the attachment section, the projections extending the entire width of the lugs.

* * * * *